United States Patent [19]

Steele

[11] 4,432,409

[45] Feb. 21, 1984

[54] ROTARY HEAT REGENERATOR WHEEL AND METHOD OF MANUFACTURE THEREOF

[75] Inventor: Donald F. Steele, Cohasset, Mass.

[73] Assignee: Northern Solar Systems, Inc., Hingham, Mass.

[21] Appl. No.: 317,756

[22] Filed: Nov. 3, 1981

[51] Int. Cl.[3] ..... F28D 19/00

[52] U.S. Cl. ..... 165/8; 165/9; 165/10; 264/248; 264/DIG. 48; 156/191; 156/194; 156/308.4; 156/309.6

[58] Field of Search ..... 165/8, 9, 10, DIG. 8; 264/248, DIG. 48; 55/390; 156/191, 194, 156/308.4, 309.6

[56] References Cited

U.S. PATENT DOCUMENTS

| | | | |
|---|---|---|---|
| 3,435,893 | 4/1969 | Withers | 264/248 X |
| 3,591,435 | 7/1971 | Snyder | 156/191 X |
| 4,093,435 | 6/1978 | Marron et al. | 165/10 X |
| 4,191,241 | 3/1980 | Brennan | 165/10 |
| 4,200,441 | 4/1980 | Honmann et al. | 165/10 X |
| 4,228,847 | 10/1980 | Lindahl | 55/390 X |

FOREIGN PATENT DOCUMENTS

| | | | |
|---|---|---|---|
| 626439 | 8/1961 | Canada | 264/248 |
| 1753830 | 5/1974 | Fed. Rep. of Germany | 156/308.4 |

*Primary Examiner*—Albert W. Davis, Jr.
*Attorney, Agent, or Firm*—Robert E. Ross

[57] ABSTRACT

This invention provides a rotary heat regenerator which includes a regenerator wheel in which the regenerator matrix is formed of at least one strip of synthetic organic plastic wound onto a central hub, with suitable spacing means being formed in the strip to form gas passages. Inexpensive means is provided to stiffen the wheel to impart lateral strength and rotational stability. In one embodiment of the invention, radial portions of the face of the matrix are fastened together by fusing, by an adhesive, or both. In another embodiment of the invention, radial apertures are formed in the wheel by forcing a heated tool, radially into the wheel periphery so that the surfaces of the strip layers of the matrix are fused together, forming a hollow cylinder bounded by a continuous layer of plastic. To impart further rigidity to the wheel, the hollow cylinder may be filled with a reinforcing rod of plastic or metal.

9 Claims, 12 Drawing Figures

ROTARY HEAT REGENERATOR WHEEL AND METHOD OF MANUFACTURE THEREOF

BACKGROUND OF THE INVENTION

In the manufacture of rotary heat regenerators, it has been considered desirable to form the regenerator matrix of a material having a low heat conductivity to minimize heat transfer between the faces of the regenerator. Synthetic organic plastic materials in film form such as polystyrene, vinyl, polyester or the like have been proposed for such use in applications where the temperature of the gases is not excessive, however a regenerator made of such material has inadequate lateral strength and rotational rigidity unless external reinforcement is provided. The cost of such additional reinforcement as used in prior types of regenerators would prevent the use of such devices in high volume, low cost applications.

SUMMARY OF THE INVENTION

This invention provides a rotary heat regenerator which includes a regenerator wheel in which the regenerator matrix is formed of at least one strip of synthetic organic plastic wound onto a central hub, with suitable spacing means being formed in the strip to form gas passages. Inexpensive means is provided to stiffen the wheel to impart lateral strength and rotational stability, so that the wheel may be safely handled for shipping and assembly into a suitable housing, and so that when the wheel, in operation, is rotated by a central hub, frictional forces applied to the wheel by sealing means in the housing and inertial forces imparted by starting and stopping cannot cause rotational shifting movement of the strip layers in relation to each other.

In one embodiment of the invention, radial portions of the face of the matrix are fastened together by fusing, by an adhesive, or both to impart the desired lateral and rotational rigidity to the wheel structure. In another embodiment of the invention, radial apertures are formed in the wheel, said apertures extending from the periphery of the wheel to or into the hub. Said apertures may be formed by forcing a heated tool, radially into the wheel periphery so that the surfaces of the strip layers of the matrix are fused together, forming a hollow cylinder bounded by a continuous layer of plastic. To impart further rigidity to the wheel, the hollow cylinder may be filled with a reincorcing rod of plastic or metal.

In either embodiment of the invention, a circumferential portion of the face of the wheel near the periphery may be provided with a smooth circular continuous surface, by fusing of the strip edges or by applying an adhesive layer, or both, to provide a sealing surface to cooperate with a seal on the wheel housing.

In a modified form of the invention, the circumferential sealing portion of the wheel may be in the form of a groove, and a sealing member may extend into the groove, terminating in spaced relation to the bottom of the groove. Said sealing member is laterally flexible, so that it can flex to seal against either the inner or outer wall of the groove, depending on the differential pressure between the opposite sides of the wheel and the housing chamber into which the wheel is assembled.

DESCRIPTION OF THE ILLUSTRATED EMBODIMENT

Figure 1:
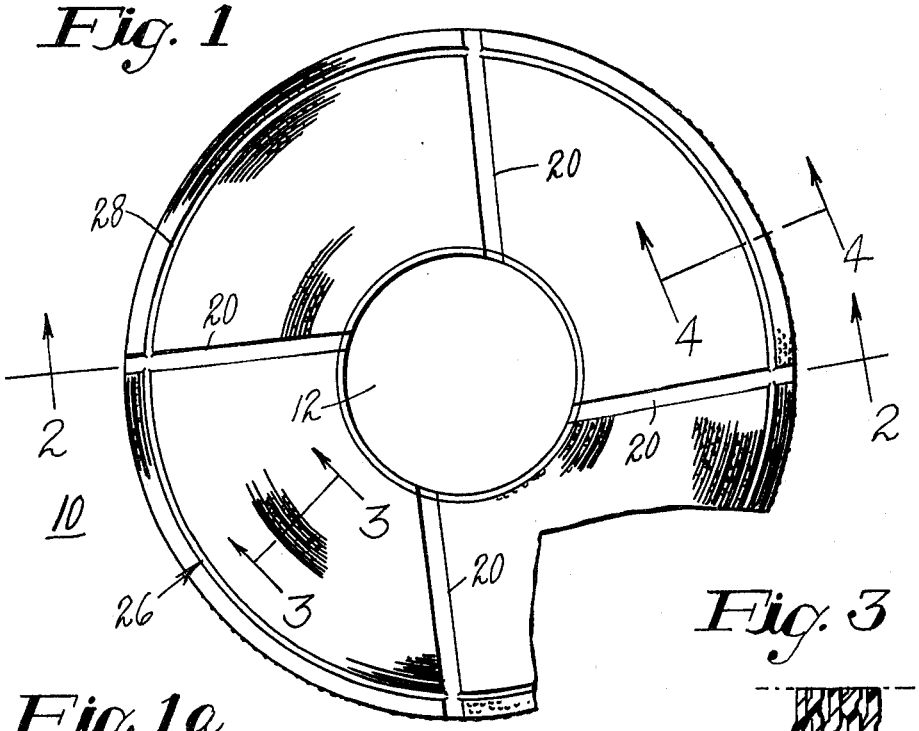
FIG. 1 is a plan view of a rotary heat regenerator wheel embodying the features of the invention.
Figure 3:
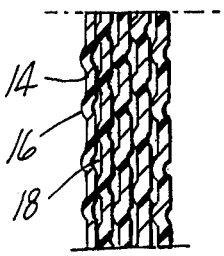
FIG. 3 is an enlarged view of the matrix of the wheel of FIG. 2.

Referring to FIGS. 1–6 of the drawing, there is illustrated one embodiment of the invention in which a rotary heat regenerator wheel 10 comprises a hub 12 and a strip 14 of thermoplastic sheet wound around the hub. The strip 14 has suitable surface projections 16 so as to provide gas passages 18 between the layers of the strip. Many types of embossments or deformations of such a strip are known in the art, and the form of surface projection shown is exemplary only.

To provide greater lateral rigidity to the wheel, and to allow rotation of the wheel by means rotating the hub 12 against the friction of a seal in a housing into which the wheel is to be assembled without causing the strip to tend to wind or unwind on the hub, a series of grooves 20 may be formed in each surface thereof by means of a heated tool of a suitable shape, such as a teflon coated cylindrical rod (not shown). When applied to the surface of the wheel, the tool melts into the edges of the layers of the strip 14 forming a groove 20, and the fused plastic from the strip edges provides the groove with a continuous smooth plastic surface 22.

In a preferred embodiment of the invention, the hub 12 is also formed of thermoplastic material of a composition which will adhere to the composition of the strip when melted. The heated tool, when applied to the surface of the wheel, also extends over the adjacent portion of the hub 12, so that the grooves 20 so formed extend into the hub 12. In this embodiment of the invention the grooves 20 are disposed at a slight angle to the radius of the wheel so that the grooves pass gradually under a seal (not shown) that divides the assembled wheel into two flow passages when the wheel is assembled into a suitable housing, as is known in the art.

Figure 1A:
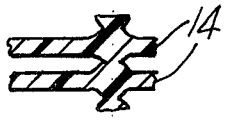
FIG. 1*a* is an enlarged plan view of a portion of one of the grooves of the wheel of FIG. 1.
Figure 2:
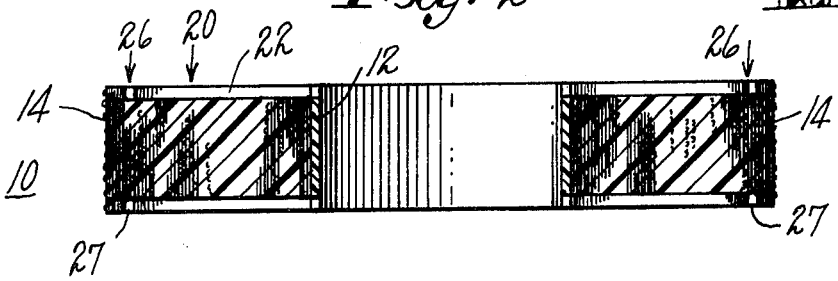
FIG. 2 is a view in section taken on line 3—3 of FIG. 1.
Figure 4:
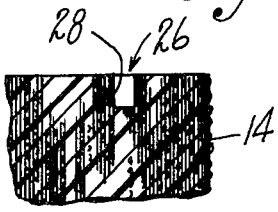
FIG. 4 is a view in section taken on line 4—4 of FIG. 1.

As illustrated in FIG. 1*a* the effect of the application of the heated rod to the strip edges which comprise the surface of the wheel is to melt said edges, causing the melted material to flow laterally into contact with melted material from adjacent strips, to form the continuous smooth groove surface.

Figure 5:
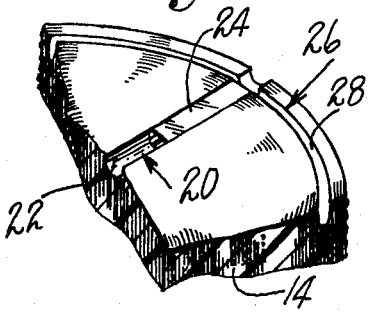
FIG. 5 is an enlarged view of a portion of the wheel of FIG. 1, in which the radial grooves have been filled with a reinforcing member.
Figure 6:
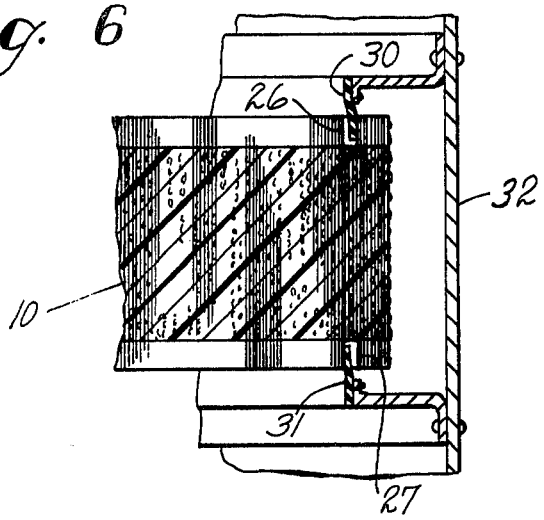
FIG. 6 is a view of the wheel similar to FIG. 2, in which the wheel has been assembled into a housing, with housing sealing members being disposed in the circumferential groove of the wheel.

In a modification of the embodiment of FIGS. 1–6, as illustrated in FIG. 5, the grooves 20 may be partially or completely filled with suitable plastic material 24 to provide additional stiffness to the wheel. Such material should be of a type that will adhere to the material of which the strip is formed. The plastic material may be either fused plastic, or may be in the form of a solid rod.

In either of the above described embodiments of the invention, each layer of the strip and the hub is bonded by fusion to the fused plastic in the groove, so that the driving force transmitted through the hub is transmitted to each of the layers of the strip.

Figure 7:
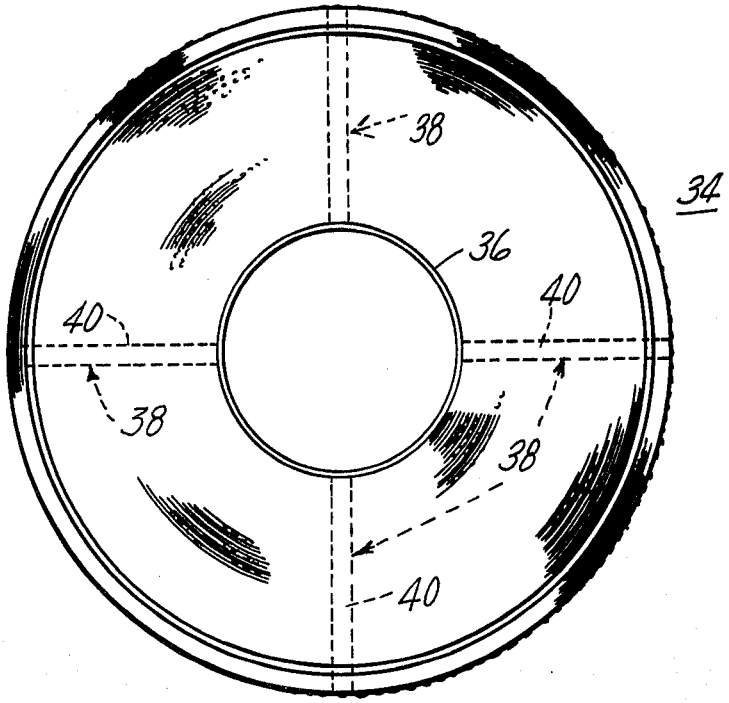
FIG. 7 is a plan view of a modified form of rotary regenerator wheel embodying the features of the invention.

To provide a surface to allow sealing the periphery of the wheel against gas leakage, peripheral grooves 26 & 27 may be provided near or at the outer circumference of the wheel on opposite sides thereof. As in the case of the grooves 20, the grooves 26 & 27 may be formed by a heated member forced into the surface of the wheel, so that the edges of the layers of strip fuse and form continuous smooth groove surface 28. As illustrated in FIG. 7, the grooves 26 & 27 are intended to cooperate with sealing members 30, 31 in a housing 32 into which the wheel is to be mounted, to prevent air flow past the edges of the wheel.

In a preferred embodiment of the invention the sealing member is a thin piece of flexible rubber or plastic. If it is assumed that in FIG. 7 the gas or air intake is the upper side of the portion of the wheel illustrated and the lower side of the wheel is the discharge side, and if it is further assumed that the pressure in the housing outside of the wheel is about ½ the difference between the intake and exhaust pressure, then the pressure of the incoming air or gas will force the seal 30 against the outside wall of the groove 26, and at the exhaust side of the wheel, the seal 31 will be flexed against the inside wall of the groove 27.

Since the groove can be accurately formed to be concentric with the center of rotation of the wheel, there will be substantially no radial oscillation of the groove walls during rotation of the wheel, and any minor oscillation can readily be accomodated by the flexible sealing members. However, the wheel may have some small amount of axial oscillation during rotation, hence the sealing members do not extend to the bottom of the grooves, to prevent interference between the bottom edge of the sealing member and the bottom of the groove if such radial oscillation occurs.

Figure 8:
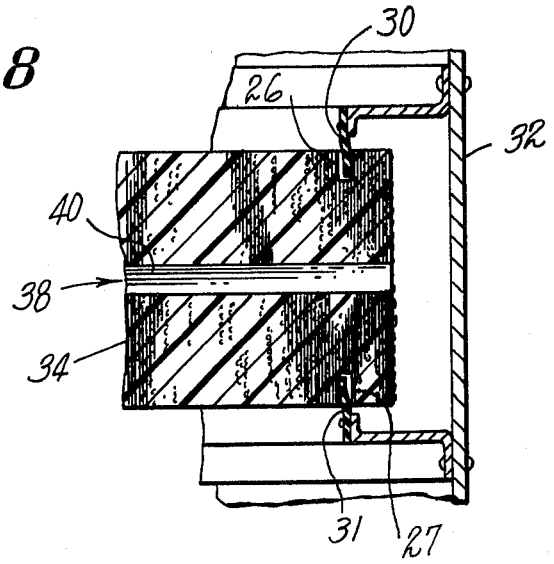
FIG. 8 is a view in section of a portion of the wheel of FIG. 7, assembled into a housing with sealing means.
Figure 11:
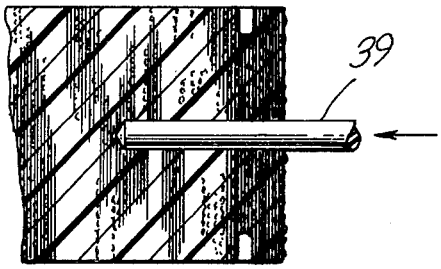
FIG. 11 is a view in section illustrating a method of manufacturing a wheel of the type shown in FIGS. 7–9.

Referring now to FIGS. 7 & 8 there is illustrated another embodiment of the invention, comprising a wheel 34 which is similar to wheel 10 in that it has a center hub 36 and a strip of thermoplastic material wound around the hub, said strip having suitable surface projections to form air passages between the strip layers, as in the device of FIGS. 1–6. In the embodiment of FIGS. 7 & 8, radial apertures 38 are formed by forcing a heated tool, such as an elongated rod 39 with a pointed heated end, radially through the layers of the strip, as illustrated in FIG. 11. The tool end, having a temperature above the melting temperature of the plastic, melts through the layers and provides an aperture with a fused surface 40 which is continuous from the hub to the outer periphery of the wheel, thereby imparting the desired lateral and radial rigidity to the wheel.

Figure 9:
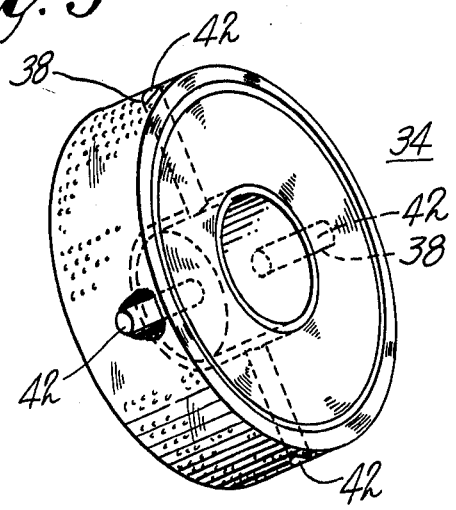
FIG. 9 is a perspective view of a modified form of the wheel of FIGS. 7 & 8.

Referring to FIG. 9, there is illustrated a modified form of the embodiment of the invention of FIGS. 7–8 in which the apertures 38 have been filled with plastic material 42 to provide additional rigidity to the structure.

Figure 10:
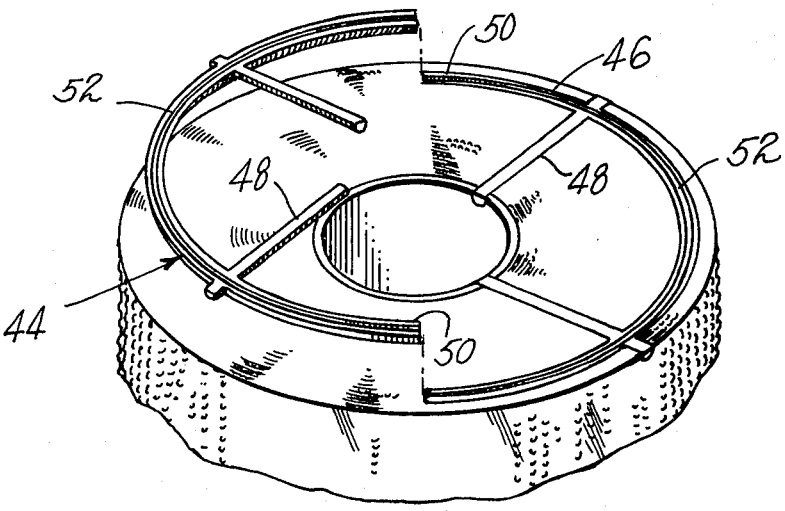
FIG. 10 is a perspective view illustrating a method of manufacturing the wheel of the type shown in FIGS. 1–6.

Referring now to FIG. 10, there is illustrated a method of manufacturing a wheel of the type shown in the embodiment of FIG. 1. As illustrated in FIG. 10, a structure 44 of material, comprising an outer ring 46 carrying inwardly projecting spokes 48, all of which may be half round in cross-section, is heated to a temperature above the melting point of the strip 14 and pressed into the face of the wheel, so that it melts its way into the edges of the strip, until the upper surface 50 thereof is flush with the face of the wheel. The structure 44 may be formed of compatable plastic having a melting point above that of the strip, or metal or ceramic with a suitable coating, if necessary, capable of adhering to the strip. In the illustrated embodiment, the ring 46 is provided with a groove 52 to provide means for receiving seal members as previously described.

Although the term "melting point" has been used herein for convenience, it will be understood that many thermoplastic materials do not have a sharply defined melting point, but a softening range, Hence the optimum temperature to which the tools or plastic inserts should be heated to form the grooves or apertures will be determined by experiment.

Since certain changes apparent to one skilled in the art may be made in the herein illustrated embodiments of the invention without departing from the scope thereof, it is intended that all matter contained herein be interpreted in an illustrative and not a limiting sense.

I claim:

1. A rotary heat recovery device, comprising a heat recovery wheel formed of spiral wound layers of at least one strip of synthetic organic plastic material and spacing means between the layers forming gas passages therebetween, in which the wheel has reinforcing means provided by narrow portions extending radially in which the layers of the strip have been adhered together.

2. A rotary heat recovery device as set out in claim 1 in which said strip is formed of thermoplastic and the adherence of the layers is effected by fusion of the layers together along a radial portion to form a continuous radial thermoplastic surface.

3. A rotary heat recovery device as set out in claim 2 in which the radial portion is formed on the surface of the wheel by fused portions of the strip edges.

4. A rotary heat recovery device as set out in claim 2 in which the radial portion is in the form of a hollow tube extending radially inwardly from the periphery of the wheel, said tube having a surface formed of fused plastic of the strips.

5. The method of providing reinforcement to a rotary heat recovery device formed of a spiral winding of at least one strip of thermoplastic material, comprising applying to said strip a heated member to form a radial fused portion.

6. A method as set out in claim 5 in which the heated member has a surface which is capable of fusing into adherence with the strip material, and said heater member is retained in assembly with the wheel.

7. A method of manufacture of a heat regenerator wheel comprising winding a spiral winding of strip material having embossments to provide gas passages around a hub, and fusing an elongated member into the side surface of the wheel.

8. A method of providing lateral and rotary reinforcement to a heat regenerator wheel formed of spiral layers of thermoplastic strip on a thermoplastic hub, comprising applying to the surface of the wheel a radial member and causing said radial member to adhere to each layer of the strip and to the hub, whereby driving force from the hub is transmitted to each layer of the strip.

9. A method as set out in claim 8 in which said radial member applies heat to the surface of the wheel to fuse the edges of the strip layers into adherence with the radial member.

* * * * *